United States Patent [19]

Capella et al.

[11] 4,443,269

[45] Apr. 17, 1984

[54] TOOL DECONTAMINATION METHOD

[75] Inventors: Joseph A. Capella, Crystal River; David E. Fowler, Gainesville, both of Fla.

[73] Assignee: Health Physics Systems, Inc., Gainesville, Fla.

[21] Appl. No.: 228,971

[22] Filed: Jan. 22, 1981

Related U.S. Application Data

[63] Continuation-in-part of Ser. No. 80,474, Oct. 1, 1979, abandoned.

[51] Int. Cl.[3] ..... B08B 3/02; B08B 15/00

[52] U.S. Cl. ..... 134/12; 134/10; 134/21; 134/25.4; 134/30; 252/630; 252/631

[58] Field of Search ..... 252/626, 631, 630; 134/10, 12, 25.1, 25.2, 186, 111, 21, 25.4, 30

[56] References Cited

U.S. PATENT DOCUMENTS

| | | | |
|---|---|---|---|
| 3,020,917 | 2/1962 | Lyman | 134/111 |
| 3,728,074 | 4/1973 | Victor | 55/74 |
| 4,235,600 | 11/1980 | Capella et al. | 252/626 |

FOREIGN PATENT DOCUMENTS

| | | | |
|---|---|---|---|
| 747970 | 8/1970 | Belgium | 252/626 |
| 2756145 | 6/1979 | Fed. Rep. of Germany | 252/626 |
| 2840138 | 3/1980 | Fed. Rep. of Germany | 252/626 |

OTHER PUBLICATIONS

E. Hollister, "Handling Radioactive Materials", G. E. Review, 1955, pp. 46–52.

*Primary Examiner*—Richard V. Fisher

*Attorney, Agent, or Firm*—Bernard A. Reiter

[57] ABSTRACT

Disclosed is a system and method for cleaning radioactively contaminated articles, including tools and like items of hardware. The system includes a cleaning chamber for receiving and sealing therein the contaminated articles, a high pressure spray gun disposed within the cleaning chamber for spraying the contaminated articles with a clean solvent to dislodge and dissolve the contaminants, and a system for decontaminating the solvent for reuse. The cleaning chamber includes a drain having the capacity to remove contaminated solvent at a rate at least as great as that at which the solvent is sprayed into the chamber, such that substantially no contaminated solvent collects in the cleaning chamber.

8 Claims, 2 Drawing Figures

TOOL DECONTAMINATION METHOD

This is a continuation-in-part of co-pending U.S. application, Ser. No. 080,474, filed Oct. 1, 1979, now abandoned.

BACKGROUND OF THE INVENTION

1. Field of the Invention

This invention relates to systems and methods for cleaning articles, and more particularly to systems and methods for cleaning radioactively contaminated tools and the like.

2. Description of the Prior Art

Tools and other articles that are used in connection with radioactive materials become contaminated. Substantially all of the contamination is in particulate form, or dissolved in various films and/or emulsions, which are located on or near the surface of the tools. Consequently, contaminated tools may be decontaminated by the removal of the particulates and the films.

In the past, methods have been suggested for cleaning radioactively contaminated tools. One method is performed by enveloping the article to be cleaned in an atmosphere of vaporized solvent. The solvent condenses upon the surface of the tool and dissolves the soluble contaminant or envelopes the particulates. The solvent is then drained off in droplet form and the articles is dried. The vapor cleaning method is not entirely satisfactory, because it depends solely upon the solubility of the contaminant and/or its ability to drip away the particulates, and does not produce any washing action to dislodge the contaminants.

Another cleaning method of the prior art involves immersing the article in a bath of solvent, and then creating currents in the bath with pumps or ultrasonics. The immersion method is somewhat more effective than the vapor method, because it combines with the action of the solvent, some washing action. However, the immersion method is not entirely satisfactory.

An improvement over the foregoing methods is disclosed in U.S. patent application Ser. No. 080,474, filed Oct. 1, 1979, by Joseph A. Capella, et al, now abandoned, which includes spraying the article with a solvent prior to immersion of the article in a solvent bath. The spraying action produces results that are superior to those of the immersion and vapor methods, but is still not entirely satisfactory. The primary shortcoming of the prior spraying system resides in the relatively low pressure of the spray produced therein. A low pressure spray is necessary in the prior system because the cleaning chamber of that system is closed, and the introduction of a high pressure spray of solvent therein would subject the chamber to excessive structural loads.

A further shortcoming of the prior spray system lies in the fact that the articles to be cleaned are placed upon a rack or screen within the chamber and sprayed by fixed nozzles. The prior spray system has no means for manipulating the article or the spray for more effective coverage.

SUMMARY OF THE INVENTION

It is therefore an object of the present invention to provide an improved system and method for cleaning radioactively contaminated articles.

It is further an object of the present invention to provide a system and method for cleaning radioactively contaminated articles with a high pressure spray.

It is a further object of the present invention to provide a system and method for cleaning radioactively contaminated articles that minimizes the risk of exposure of cleaning personnel to exposure.

Briefly stated, the foregoing and other objects of the present invention are accomplished by providing a cleaning chamber that is adapted to contain the contaminated articles to be cleaned. Low pressure fixed nozzles for rinsing are arranged within the cleaning chamber to direct sprays of a clean solvent upon the articles to dislodge and dissolve the contaminants. A manually-operated, high pressure, spray gun for cleaning is provided to direct a high pressure solvent spray onto areas not cleaned by the low pressure (high volume), solvent flushing produced by the fixed nozzles. The cleaning chamber is constructed such that the solvent sprayed therein runs immediately to a drain, which drain has the capacity to drain the solvent from the cleaning chamber at a rate at least as great as that at which the cleaned solvent is sprayed thereinto, such that substantially no contaminated solvent collects in the cleaning chamber. The system further includes means for decontaminating the contaminated solvent drained from the cleaning chamber for perpetual reuse.

The decontaminating means includes a macroscopic particulate trap which collects from the contaminated solvent large particles. The large particles frequently comprise expensive enriched nuclear fuels, which may be reclaimed and recycled, but may also include portions of the articles to be cleaned (i.e. screws, nuts, etc.), which are collected and returned to the operator. The decontamination means further includes a solvent drained from the cleaning chamber. A recirculation loop is provided to withdraw solvent from the solvent reservoir, filter the solvent to remove substantially all particulate contaminants suspended therein, and redeposit the filtered solvent into the solvent reservoir. A low pressure high volume pump is provided in the recirculation loop to pump the solvent through the filter so as to clean the entire contents of the solvent reservoir in a short period of time and to direct a part of the solvent stream back into the cleaning chamber for the previously stated purpose of low pressure washing of contaminated objects through the fixed nozzles and high presssure washing through the gun.

High pressure solvent is supplied to the cleaning chamber by a high pressure, low volume pump that is adapted to channel part of the solvent from the recirculation loop downstream of the low pressure filter.

A fan is provided to exhaust solvent vapors from the cleaning chamber during operation. The discharge from the fan is condensed to recover vaporized solvent, which produces a slight sub-atmospheric pressure in the cleaning chamber. Any remaining gases discharged from the system are filtered to remove substantially all suspended particulate matter and solvent vapor not condensed in the condenser.

A still is provided for periodic batch distillation of the solvent to remove contaminants dissolved therein.

DESCRIPTION OF THE PREFERRED EMBODIMENT

Figure 1:
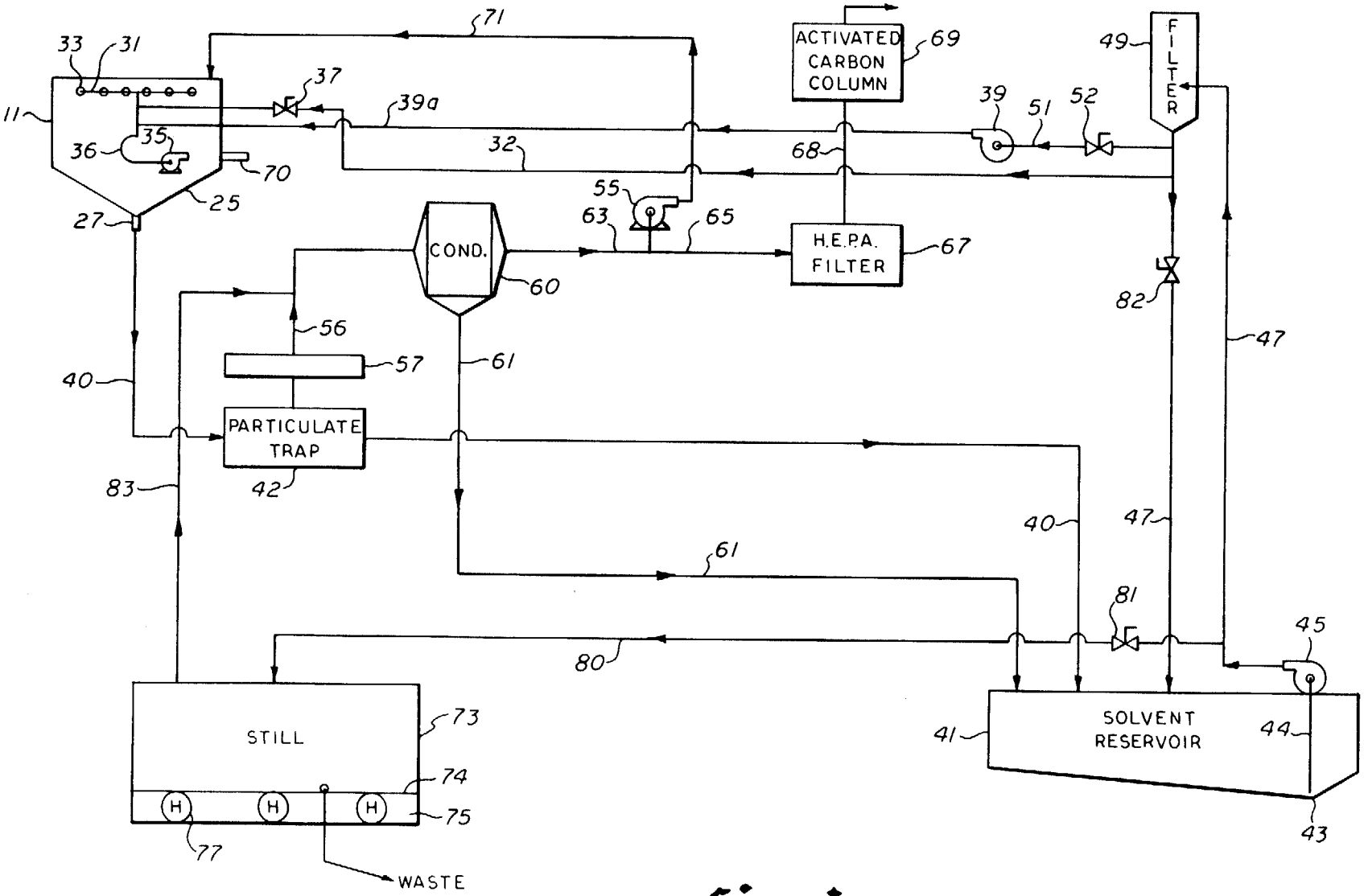
FIG. 1 is a schematic diagram of the system of the preferred embodiment of the invention.
Figure 2:
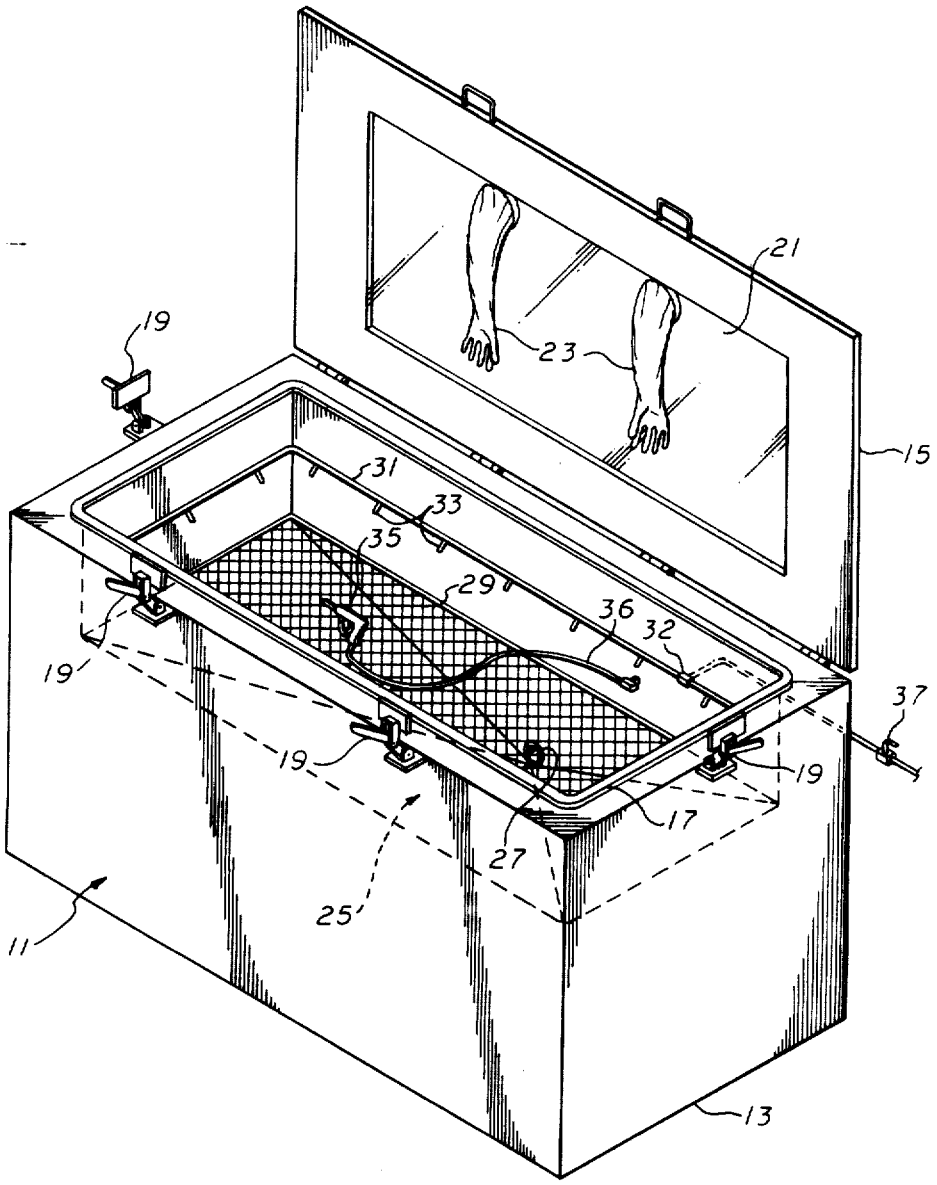
FIG. 2 is a perspective view of the cleaning chamber of the preferred embodiment of the invention.

Referring now to the drawings, the system of the present invention is illustrated schematically in FIG. 1. The system includes a cleaning chamber 11 which is adapted to contain the articles to be cleaned. As best shown in FIG. 2, cleaning chamber 11 includes a cabinet 13 with a lid 15 hingedly connected thereto. A gasket 17 is provided to form a gas tight seal between cabinet 13 and lid 15 when cleaning chamber 11 is closed. A plurality of latches 19 are provided for securely latching lid 15 in the closed position.

Lid 15 includes a window 21 through which an operator may view the interior of cleaning chamber 11 when lid 15 is closed. Window 21 has mounted thereto a pair of gloves 23, by which the operator may handle the articles during the cleaning process and perform other operations as will be described hereinafter.

The interior of cabinet 13 includes a Vee-broken bottom 25 that slopes inwardly and downwardly to a drain 27. Disposed above bottom 25 is a removable screen 29 which is adapted to support the articles being cleaned. Mounted above screen 29 is a manifold 31 that is supplied with low pressure solvent through a conduit 32. Conduit 32 has connected thereto a plurality of nozzles 33, which are arranged to spray high volume, low pressure solvent into the interior of cleaning chamber 11 to clean the articles placed on screen 29. Also included is a spray gun 35 which is connected to a low volume, high pressure pump 39 by a flexible hose 36 and exterior conduit 39A. The operator, by placing his hands in gloves 23, may manipulate spray gun 35 and the articles being cleaned to provide maximum cleaning action. A valve 37 is provided outside the chamber so that the operator may supply low pressure fluid from conduit 32 to the fixed nozzles 33. Solvent is supplied to conduit 32 by a low pressure high volume pump 45.

The solvent of the preferred embodiment of the system is pure trichlorotriflouroethane, which is marketed under the trade name FREON 113. FREON 113 is very active and aggressive, and is therefore an excellent solvent. It is moreover particularly well suited as a solvent in the system of the present invention, because it is a liquid at room temperature and in the desired operating range of the system, but boils at a relatively low temperature, which is much lower than the boiling point of the contaminants to be cleaned. Also, FREON 113 has a low viscosity and high penetrability, which when combined with the high pressure spray of the present invention make it excellent for cleaning porous articles, as for example, those made of rubber, plastic and porous metals.

The contaminants removed from the articles by the action of the solvent sprayed thereon are washed immediately to drain 27. In the preferred embodiment, pump 39 is a positive displacement pump that is designed to deliver solvent at a range of 4 to 4.6 gallons per minute at a pressure in the range of 2,000 to 2,400 pounds per square inch. Drain 27 is open at all times during cleaning, and is configured to drain solvent from cleaning chamber 11 at a rate at least as great as that at which solvent is sprayed into chamber 11. Accordingly, substantially no contaminated solvent collects in cleaning chamber 11, which thereby reduces potential exposure to persons outside cleaning chamber 11 during operation.

Contaminated solvent from drain 27 is conducted through a conduit 40 to a solvent reservoir 41. Disposed in conduit 40 between drain 27 and solvent reservoir 41 is a particulate trap 42 which is adapted to collect relatively large particles of material removed from the articles being cleaned. These large particles may include plutonium or enriched uranium, which are very valuable and which should be reclaimed. The particles may also include portions or pieces of the articles being cleaned, such as nuts and bolts.

Solvent reservoir 41 is a v-bottom tank having a capacity in the preferred embodiment of approximately 50 gallons. The v-bottom construction of solvent reservoir 41 causes sediment to settle toward the bottom of the v, designated by the numeral 43. A pump 45 is provided to withdraw solvent from solvent reservoir 41 through a pickup tube 44, which is disposed adjacent to v-botton 43. The discharge from pump 45 is connected to a recirculating conduit 47, which is connected through a filter 49 back to solvent reservoir 41. Filter 49 is adapted to remove substantially all particulate matter suspended in the solvent down to and including diameters of 0.5 microns. Pump 45 is a high volume, low pressure pump. The pressure is selected to be low enough that it does not damage filter 49, and in the preferred embodiment is approximately 50 pounds per square inch. The volume delivered by pump 45 is selected to circulate the entire capacity of solvent reservoir 41 through filter 49 at least approximately once every one and one-half minutes, and in the preferred embodiment is in the range of thirty to forty-five gallons per minute. Accordingly, the solvent in solvent reservoir 41 is decontaminated substantially continuously, and the level of contamination therein is kept quite low. The contaminant is collected in filter 49, which may be shielded or placed in a remote location, so as to minimize the exposure to personnel.

High pressure pump 39 is supplied with fluid from recirculation conduit 47 by a supply conduit 51. Supply conduit 51 is connected to recirculation conduit 47 down stream from filter 49, whereby the solvent supply thereto has been filtered, and is therefore clean. A valve 52 is provided to isolate pump 39 from recirculation conduit 47 when pump 39 is not in operation or requires removal or maintenance. During operation, valve 52 is opened to communicate supply conduit 51 with recirculation conduit 47. Since pump 39 pumps a volume substantially smaller than that pumped by pump 45, pump 39 is always supplied with positive pressure with which to satisfy its demands. Recirculation conduit 47 is also connected to conduit 32 which communicates low pressure, high volume solvent from pump 45 to the cleaning chamber nozzles 33 via conduit 31. A valve 37 is provided to shut off solvent flow to nozzles 33. During operation, filtered solvent from pump 45 is diverted to the spray nozzles 33 by opening valve 37. Additional solvent flow to the nozzles 33 can be achieved by throttling a valve 82 in conduit 47, which is normally open. During this mode of operation, solvent is still supplied to high pressure pump 39, as well as solvent reservoir 41.

When solvent is initially sprayed into cleaning chamber 11 through nozzles 33 or spray gun 35, a large internal pressure surge is created, which would tend to place excessive structural loads upon cleaning chamber 11 and blow out gloves 23. In order to reduce such initial pressure surge, a fan 55 is provided. Fan 55 is connected to particulate trap 42 by a conduit 56 having a lint filter 57 disposed therein. Fan 55 functions to pull gases out of cleaning chamber 11 through drain 27 and across a condenser 60 by way of a conduit 63. The discharge from fan 55 is connected through a conduit 71 back to cleaning chamber 11. Condenser 60 is operated by conventional refrigeration equipment and functions to condense the vapor components of the gases, which are drained from condenser 60 through conduit 61 to solvent reservoir 41. The gases not condensed in condenser 60 and not returned by fan 55 are vented by a pressure relief line 65. The gas in pressure relief line consists primarily of air with some minute amounts of solvent vapor and some suspended particulate contaminants. The gases are filtered by a high efficiency particulate air filter 67 connected to pressure relief line 65 to remove 99.97% of all suspended particulate contaminants measuring 0.3 microns and larger. The gas is then fed through a conduit 68 to a column of activated charcoal 69, which removes substantially all solvent vapor, and whereupon the gas, which is now clean air, is vented to the atmosphere.

After the initial surge of pressure, substantially all of the air in cleaning chamber 11 is removed, and the atmosphere within chamber 11 consists primarily of solvent vapors. The solvent condenses relatively quickly and, accordingly, the system operates at a sub-atmospheric pressure. The sub-atmospheric operation of the system provides an addition safety feature in that any leaks which may occur are from the exterior into the interior or chamber 11, thereby preventing the escape of contaminants. A vapor return line 71 is also provided.

After a period of operation, the level of dissolved, rather than suspended, contaminants in the solvent may increase to a level such that when the articles are dried after cleaning, a film of contaminant is left thereon. In order to remove the dissolved contaminants from the system, a still 73 is provided. Still 73 has a capacity to distill at one time the entire volume of solvent in the system. Still 73 comprises generally a vessel having a false bottom 74 which forms a cavity 75. Cavity 75 is filled with an oil bath and has disposed therein a plurality of heating elements 77. Heating elements 77 are designed to heat the oil bath to a desired temperature above the boiling point of the solvent.

Still 73 is connected to recirculation conduit 47 by a conduit 80, which has therein a valve 81. When it is desired to distill the solvent, valve 81 is opened and pump 45 is actuated to pump the entire contents of solvent reservoir 41 and filter 49 into still 73. Valves 82, 52 and 37 are closed during this operation. Heating elements 77 are then actuated to heat the oil bath and thereby heat the solvent contained within still 73. When the temperature within still 73 reaches the boiling point of the solvent, that temperature is maintained according to the laws of thermodynamics until substantially all of the solvent has been evaporated, whereupon the temperature begins to rise. Means are provided for automatically deactivating heating elements 77 when the temperature in still 73 rises above a preselected temperature. The preselected temperature is preferably substantially less than the boiling point of water or any of the contaminants.

The vapor from still 73 is removed by a conduit 83. Conduit 83 is connected to conduit 59 to condenser 60 and through fan 55. The vapor from still 73 is condensed in condenser 60 to form pure liquid solvent, which is conducted to solvent reservoir 41 by conduit 61.

In operation, radioactively contaminated articles, such as tools and the like, are deposited in cleaning chamber 11 upon screen 29, whereupon lid 15 is closed and latched. Pump 45 is actuated to circulate solvent through recirculation conduit 47. Valve 52 is opened to supply solvent to pump 39, which is actuated to supply high pressure solvent to the spray gun 35 via conduit 39A. The operator, by manipulating valve 37 can also direct low pressure solvent through nozzles 33 onto the contaminated articles. The operator, by means of gloves 23, can manipulate the articles and spray gun 35 to clean the articles effectively.

All of the contaminated solvent is drained continuously through drain 27 into solvent reservoir 41. Macroscopic particles are collected in particulate trap 42, from which such particles may be reclaimed. The solvent within solvent reservoir 41 is continuously cleaned by filter 49, which may be shielded or located remotely from the cleaning area, thereby to minimize risks of exposure. After filter 49 has collected a sufficient amount of contaminants, it may be disposed of in the conventional manner. When the level of dissolved contaminant in the solvent exceeds a predetermined level, the solvent is batch distilled in still 73, thereby to remove the dissolved contaminants and any remaining particulate contaminates. The waste product after distillation of the solvent may be cleaned out of still 73 and disposed of in the usual way.

It is thus seen that there is provided an improved decontamination system and method. Although the invention has been described and illustrated with a certain degree of particularity, it is to be understood that the present disclosure is made by way of example only, and that various chnges and modifications in the details of the construction and the arrangement of the parts may be resorted to without departing from the spirit and scope of the invention as hereinafter claimed.

What is claimed is:

1. In the method for cleansing radioactively contaminated articles in a sealed cleaning chamber in which the articles are manipulated therethrough during the cleaning steps so as to facilitate the dislodging and dissolving of the contaminants, all while maintaining physical integrity of the chamber against escape of radioactive gases, comprising the steps of:

sealing the contaminated articles in a cleaning chamber;

spraying the contaminated articles in the cleaning chamber with a clean solvent at an elevated pressure greater than atmospheric to thereby dislodge and dissolve the contaminant and clean the articles while simultaneously exhausting the air from the chamber to produce a sub-atmospheric pressure in the chamber while introducing solvent to the chamber;

washing the articles with clean solvent under low pressure and high volume relative to the solvent sprayed on the articles at elevated pressure;

simultaneously draining, while spraying, the contaminated solvent under pressure less than atmospheric from the cleaning chamber thus substantially precluding breach of the seal of the chamber and escape of radioactive gas or liquid due to the spraying of solvent at an elevated pressure greater than atmospheric;

said draining step being conducted at a rate at least as great as that which the clean solvent is introduced into the cleaning chamber, whereby substantially no contaminated solvent is collected therein; and decontaminating the contaminated solvent drained from the cleaning chamber for reuse in the spraying steps;

collecting in a solvent reservoir the contaminated solvent drained from the cleaning chamber;

withdrawing solvent from the solvent reservoir so as to cleanse the solvent;

filtering the solvent withdrawn from the solvent reservoir to remove substantially all particulate contaminant suspended therein; and returning the filtered solvent into the solvent reservoir;

said withdrawing and filtering steps including pumping said solvent from the solvent reservoir through a filter at a volume substantially greater and a pressure substantially lower than the solvent sprayed on the articles to thereby enhance integrity of the filtration system, also.

2. The method of claim 1 wherein that solvent conducted to the cleaning chamber under high pressure and low volume becomes partially vaporized due to said high pressure upon entry thereinto;

continually withdrawing said vapors from the chamber to both prevent pressure surge and draw contaminated vapor to a condenser;

condensing the contaminated solvent component in vapor form; and conducting the solvent in liquid form from the condenser to the reservoir so that it may be recirculated at said low pressure high volume condition.

3. The method as claimed in claim 1 including the steps of:

withdrawing a part of the solvent after it has been filtered and pumping it at said elevated pressure and low volume to the cleaning chamber to perform said spraying step, while conducting the remainder of the solvent originally pumped to the filter at said high volume and said pressure lower than said spraying pressure back to the aforesaid reservoir.

4. The method as claimed in claim 1, including the further step of:

periodically distilling the filtered solvent to remove dissolved contaminants therefrom.

5. The method as claimed in claim 4, wherein the distilling step includes the steps of:

evaporating the filtered solvent;

condensing the evaporated solvent;

separating the condensed solvent from any water condensed therewith;

and returning the separated solvent to the solvent reservoir.

6. The method as claimed in claim 1, including:

withdrawing gases from the cleaning chamber, together with the contaminated solvent;

liquifying the solvent vapor in the gases withdrawn from the cleaning chamber;

removing from the gases after the liquifying step substantially all particulate matter suspended therein;

and removing from the gases substantially all solvent vapor not liquified during the liquification step.

7. The method for cleansing radioactively contaminated articles in a chamber in which the articles are manipulated therethrough during the cleaning steps so as to facilitate the dislodging and dissolving of the contaminants while simultaneously exhausting air from the chamber, the chamber being coupled to a solvent recirculation circuit, all defining a system wherein solvent is sprayed onto the articles in the chamber at a first elevated pressure at low volume, and recirculated and cleansed of contamination at a second substantially lower pressure in order to reduce the high pressure forces otherwise contained within the chamber and recirculation circuit of the system and thus enhance safety during cleansing by subjecting the parts thereof to less stress, comprising the steps of:

spraying a radioactively contaminated article in a closed chamber with a liquid solvent under a first elevated pressure and during which a portion of the pressurized solvent becomes vaporized upon entry into the expanded volume of the chamber;

withdrawing the contaminated liquid-vapor solvent under a second, substantially lower pressure than said first elevated pressure and conducting the solvent under said lower pressure to a particulate trap where macroscopic particles are removed from the solvent while simultaneously reducing pressure surge in the chamber;

chilling the vaoor component of the solvent to liquify it and conducting the liquified solvent to a reservoir while conducting residual vapor back to the chamber;

conducting solvent at such second and lower pressure from said reservoir through a filter system to cleanse said solvent, thus insuring both integrity of the filter and the liquid character of the solvent so as to thereby reduce the possibility of escape of radioactive contaminant from the chamber and circuit; and conducting a part of the solvent stream emanating from said filter into a high pressure pump to supply solvent thereafter to said first elevated pressure low volume spray in said chamber while the balance of the solvent emanating the filter is returned at said second lower pressure to the solvent reservoir.

8. The method of claim 7, including the additional step of heating the solvent in the recirculation circuit and conveying it in vapor phase through said chilling step as hereabove described and at said second pressure level.

* * * * *